US005382017A

United States Patent [19]

Pippert

[11] Patent Number: 5,382,017

[45] Date of Patent: Jan. 17, 1995

[54] BASKETBALL NET WITH ADJUSTABLE RETURN CONTROL

[76] Inventor: Jon P. Pippert, 1500 SW. Park Ave., #317, Portland, Oreg. 97201

[21] Appl. No.: 246,519

[22] Filed: May 20, 1994

[51] Int. Cl.[6] ..... A63B 69/00

[52] U.S. Cl. ..... 273/1.5 A

[58] Field of Search ..... 273/1.5 A, 1.5 R, 396, 273/397

[56] References Cited

U.S. PATENT DOCUMENTS 3,814,421 6/1974 Spier, Jr. ..... 273/1.5 A
4,957,289 9/1990 Kotlarz ..... 273/1.5 A
5,165,680 11/1992 Cass ..... 273/1.5 A
5,273,276 12/1993 Warren ..... 273/1.5 A

*Primary Examiner*—Paul E. Shapiro
*Attorney, Agent, or Firm*—Marger Johnson

[57] ABSTRACT

A basketball net assembly includes multiple elongated flexible channel straps each having a top end that attaches to a basketball rim and bottom end. Several flexible support straps each have a center portion attached transversely across the channel straps. Opposite ends of the support straps attach to the rim. The support straps when attached to the rim form the channel straps into a downwardly sloping concave arch shape. The slope of the channel straps control the angle and speed in which a basketball exists the net.

20 Claims, 6 Drawing Sheets

BASKETBALL NET WITH ADJUSTABLE RETURN CONTROL

BACKGROUND OF THE INVENTION

This invention relates generally to basketball nets and more particularly to an adjustable basketball net that can be quickly attached and detached to a basketball rim.

Conventional basketball nets have an inverted conical shape and are attached to brackets welded onto the basketball rim. Depending upon the direction in which a basketball travels through the rim, the basketball can exist through the bottom of the net at different angles. For example, basketballs falling straight down through the center of the rim fall vertically downward when exiting the net. Alternatively, if the basketball falls through the rim slightly off-center, the basketball may touch the rim before falling through the net. The basketball can then bounce forward, backward, to the left, or to the right after falling through the net.

If the basketball constantly exits the basketball net at different angles, a basketball player must continuously retrieve the basketball from different locations after shooting the basketball. If the basketball player is shooting alone, additional time is, therefore, required to retrieve the ball reducing the number of shots that can be taken in a given amount of time.

Further, outdoor basketball courts are often located next to hills, streams, and other undesirable locations where the basketball may bounce after traveling through the basketball net. If the basketball continuously rolls down a hill after falling through the net, additional time must be spent retrieving the basketball, deterring from the overall enjoyment of the basketball game.

Many systems have been developed for controlling the direction that a basketball bounces after being shot through a basketball rim. U.S. Pat. No. 3,945,368 to Luebkeman and U.S. Pat. No. 4,957,289 to Kotlarz both describe rigid metal rails held at an angle below a rim by either chains or straps. The ball after passing through the basketball rim, falls onto the rail returning out a front opening in the net. The metal rails, however, are dangerous since a player can strike his hands on the rails while driving to the basket. Thus, both the systems in Kotlarz and Luebkeman can not be used in a normal basketball game.

U.S. Pat. No. 4,720,101 to Farkas, Jr. and U.S. Pat. No. 5,184,814 to Manning describe rotatable chute members that are attached by mechanical attachment assemblies to the basketball rim. Again, a basketball player can easily strike the rigid attachment assemblies while shooting around the rim. Thus, neither system is appropriate for use in a basketball game.

Both the systems in Farkas, Jr. and Manning return the ball at the same vertical angle and speed. However, it is often desirable to return the ball at a different angle or speed depending upon where the shot is taken. For example, if the ball is shot close to the rim, it may be more desirable for the ball to exit the net in a more horizontal direction. Alternatively, if the shot is taken further away from the rim, it may be desireable to have the basketball exit the net at a more vertically directed angle to maintain sufficient speed to return to the shooter.

U.S. Pat. No. 4,834,368 to Qualley describes a basketball net that includes a continuous strip of Velcro TM that wraps around a rim. While Velcro is easy to attach, it cannot be attached around an exiting basketball net. For example, the loops in a conventional net will be sandwiched between the hook and eye portions of the Velcro making the strength of the attachment weaker. Thus, an existing net must first be removed before the net in Qualley can be installed.

Accordingly, a need remains for an easy to install basketball net that can be adjusted to vary the direction and speed of a returning basketball while at the same time remain flexible enough for use during a standard basketball game.

SUMMARY OF THE INVENTION

It is, therefore, an object of the invention to increase the adjustability of a basketball net.

Another object of the invention is to control the return direction and return angle of a basketball exiting from a basketball net.

A further object of the invention is to reduce the cost and increase the utility of nets that provide adjustable return path control for basketballs.

A basketball net controls both the horizontal return angle and the vertical return angle of a basketball. The net is quickly attachable onto a rim over a conventional net for temporary use. The net is also flexible enough to be used safely during a regular basketball game.

The basketball net includes multiple elongated flexible channel straps each having a top and bottom end. The top end of each channel strap has a slit that attaches through the brackets welded on the basketball rim. Several flexible support straps each have a center portion attached transversely across the channel straps. Opposite ends of the support straps have slits that also attach onto associated rim brackets. The support straps when attached to the rim form the channel straps into a downwardly sloping concave arch shape. The slope of the channel straps control the angle and speed in which a basketball exists the net.

Slits can be positioned at different locations at the ends of the support straps to vary how far the center section of each support strap hangs below the rim. Thus, the shape of the arch formed with the channel strap can be varied to control the vertical angle that the basketball exists the net. The channel straps and support straps are made of a flexible fabric type material to maintain the pleasing audio and visual sensation experienced from shooting a basketball through a net.

The flexible straps also allow the net to be safely used during a basketball game without the fear of a player's hand striking a rigid net support assembly. Semi-rigid plastic bands are inserted between the channel straps and the support straps for increasing the ability of the straps to control the return path of the basketball. The bands, however, are flexible enough to conform to the shape of the attached strap. In one embodiment, the bands comprise elongated rectangular pieces of plastic detachable from the channel and support straps.

As mentioned above, each strap has slits that attach onto a basketball rim bracket. Different slits are attached to the brackets to vary both the arch in which the channel straps drape down below the rim. At the same time, the separate slits allow the net to be repositioned in any radial angle around the rim. Thus, the net can be attachable to the rim so that the basketball returns to any given location on a basketball court. The net does not use any metal parts and, therefore, is inexpensive to manufacture and can be used in the same capacity as a conventional basketball net.

The foregoing and other objects, features and advantages of the invention will become more readily apparent from the following detailed description of a preferred embodiment of the invention which proceeds with reference to the accompanying drawings.

DETAILED DESCRIPTION

Figure 1:
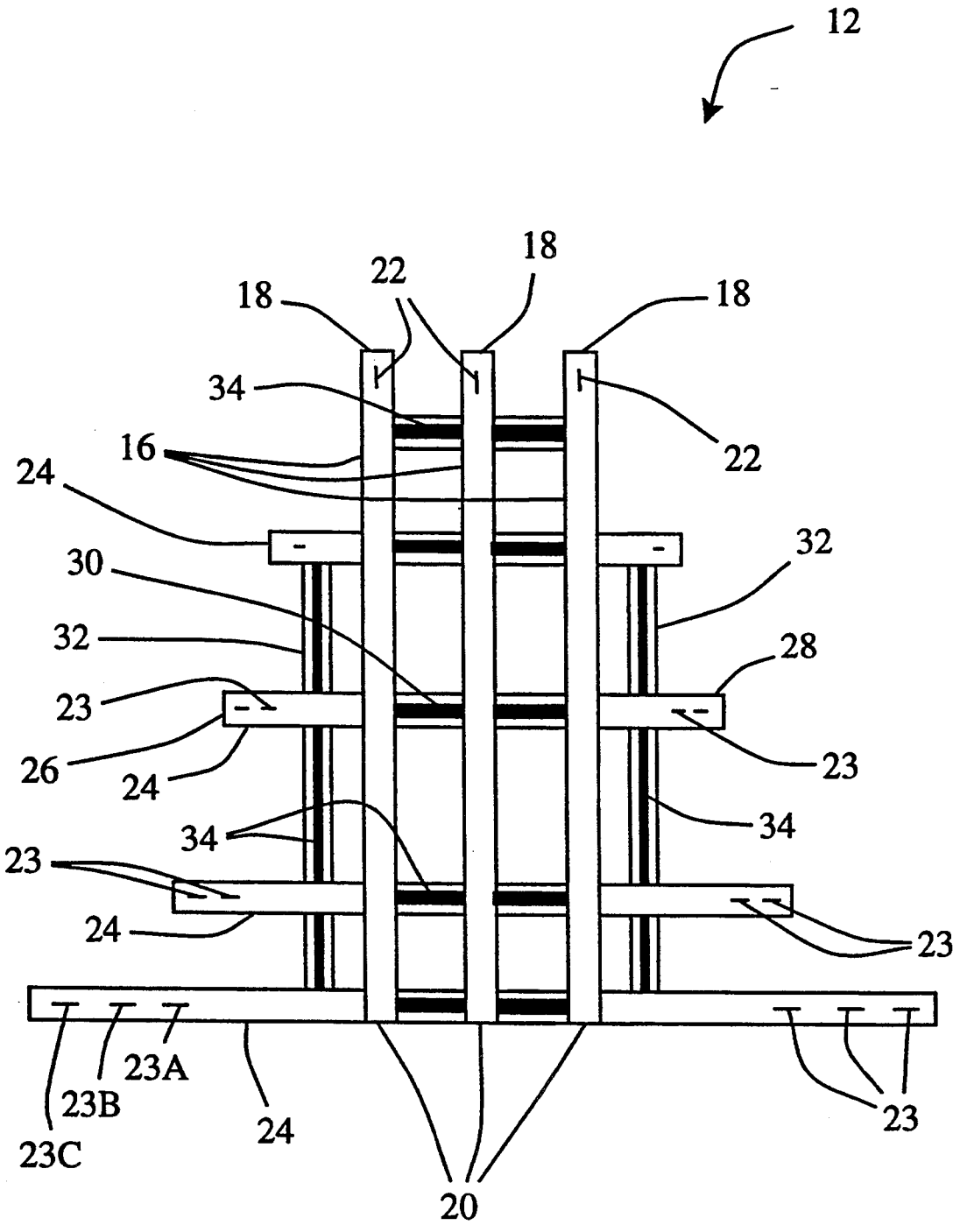
FIG. 1 is a top plan view of a basketball net according to the invention shown in a flattened position.
Figure 3:
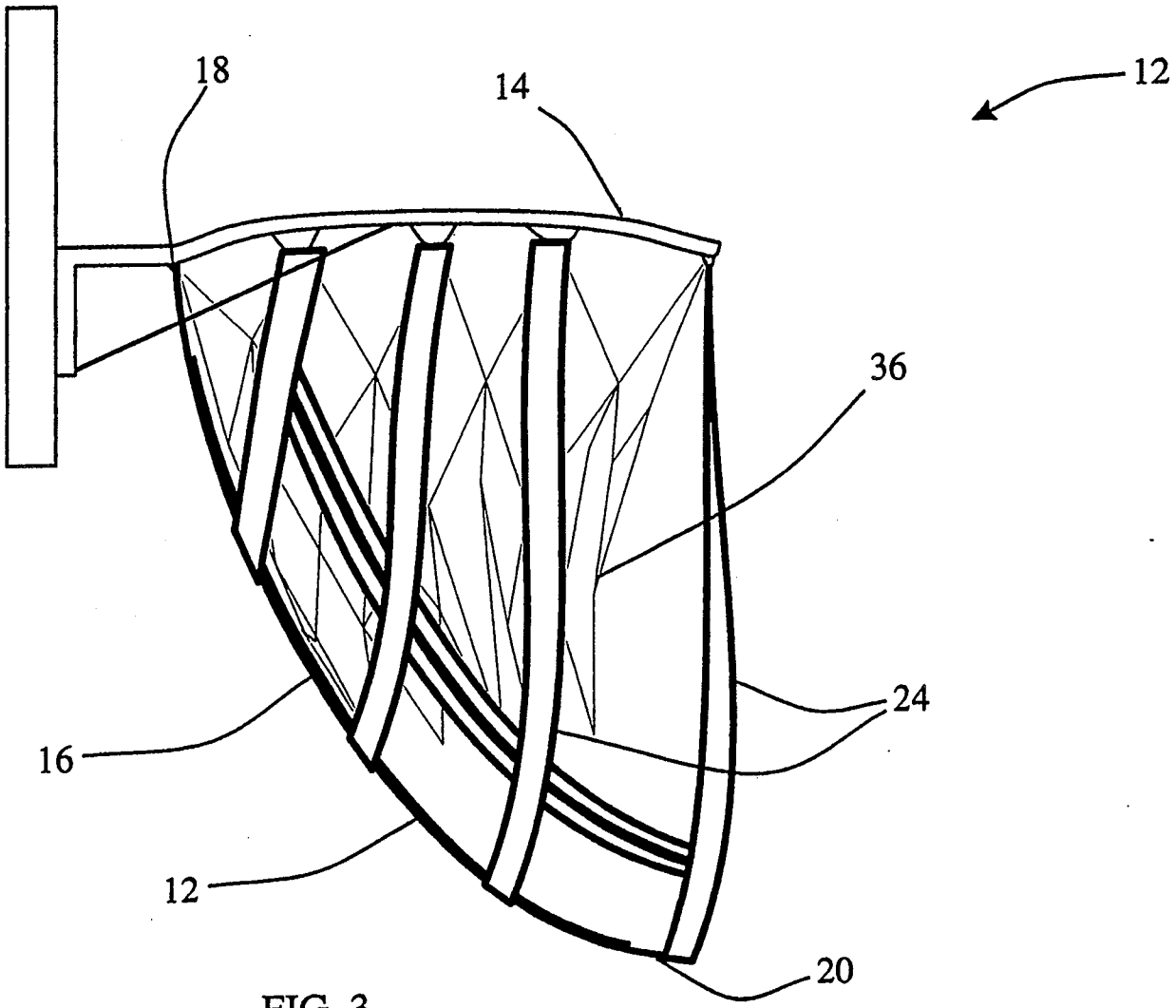
FIG. 3 is a side elevation view of the basketball net in FIG. 1 shown attached to a basketball net.

FIG. 1 is a top plan view of a basketball net 12 according to the invention. The basketball net 12 directs the return path of a basketball (not shown) after passing through a conventional basketball rim 14 (FIG. 3). The basketball net 12 comprises multiple elongated flexible channel straps 16 each having a top end 18 and a bottom end 20. The top end 18 of each channel strap 16 includes attachment means 22 for coupling net 12 directly onto the basketball rim 14. In the embodiment shown in FIG. 1, the attachment means comprise slits in the top end 18 of each channel strap 18.

A set of flexible support straps 24 each have a first end 26, a second end 28 and a center portion 30. The center portion 30 of support straps 24 are attached laterally across the channel straps 16. Side straps 32 are attached to the support straps 24 at the lateral sides of the channel straps 16.

Adjustment means 23 are joined to the first and second ends 26 and 28, respectively, of each support strap 24. The slits 23 on support straps 24 are similar to those existing on the top end 18 of channel straps 16.

The position of slits 23 determine how far the center section 30 of each support strap 24 hangs below the rim 14. For example, when the slits are positioned further from the ends of the associated straps, the center section 30 of each support strap will hang a given distance underneath the rim. However, when the slits 23 are moved closer to the ends of the associated straps, the center section of each support strap will hang further below the rim. The distance that the center sections of the support straps hang below the rim determine the shape of the arch formed with the channel straps 16 when hanging below rim 14 (see FIG. 3). The attachment of slits 23 onto rim 14 is shown in more detail in FIG. 6.

Alternative attachment means 23 such as velcro are also readily used for attaching the ends of straps 16 and 24 to the rim 14. For example, the attachment means for each strap can comprise individual hook and eye sections each having an elongated rectangular shape. The hook section is attached to the farthest most end of an associated strap. The hook section wraps around the rim 14 and mates with a corresponding eye section attached below the hook section.

In another embodiment, the attachment means comprise snaps located on the farthest most end of each strap. The snaps have a male member positioned at the end of an associated strap. The male member is wrapped around the rim 14 and insertable into a corresponding female receptor positioned below the male member.

The channel straps 16 and support straps 24 in one embodiment are made of a flexible fabric type material such as canvas and has an elongated rectangular shape.

Semi-rigid plastic bands 34 are attachable onto both the bottom side of channel straps 16 (see FIG. 2) and the top side of the center section 30 of support straps 24. The bands 34 increase the rigidity of the associated straps while at the same time conforming to the shape of the attached strap as it drapes underneath rim 14.

The bands 34 are attached to straps 16 and 24 by inserting each band through openings that exist between the intersections of channel and support straps. For example, horizontal support strap bands 34 are inserted underneath each channel strap 16 and over the top side of the center portion of each support strap. Thus, the bands are easily removable when the net rigidity is not required.

Figure 2:
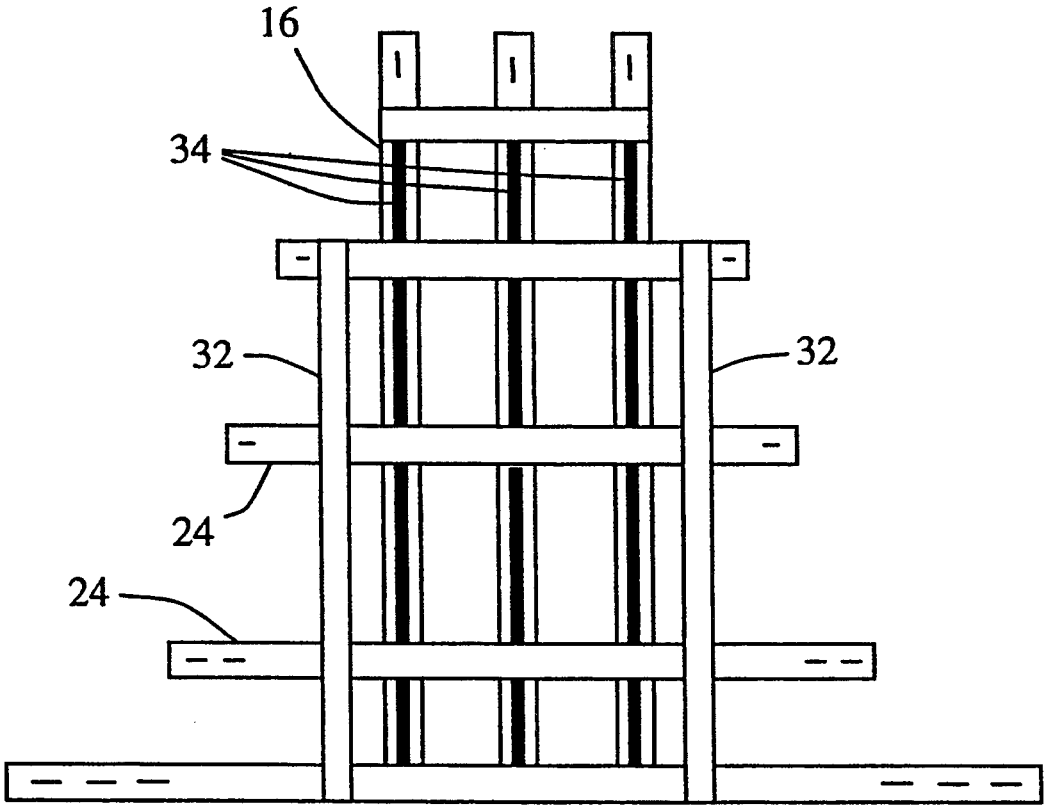
FIG. 2 is a bottom plan view of the basketball net shown in of FIG. 1.

FIG. 2 is a bottom plan view of the basketball net 12 of FIG. 1. It can be seen that bands 34 extend the length of each channel strap 16. The channel strap bands are attached by sliding each band through the opening between intersecting channel and support straps, over the top of each support strap 24 and underneath the associated channel straps 16.

Referring to FIG. 3, the basketball net 12 is attached to a conventional basketball rim 14 and draped over a conventional basketball net 36. The channel straps 16 hang between a back section of the basketball rim 14 and the middle section 30 of front support strap 24. The channel straps 16 hang underneath rim 14 in a concave arch shape.

The slits 23 (FIG. 1) on the ends of support straps 24 vary the length that the center section of each associated support strap extends below the rim 14. Thus, wrapping the different slits 23A, 23B, and 23C onto rim 14 adjust the angle of the arch formed by the channel straps 16. For example, wrapping the inside slits 23A (FIG. 1) of each support strap around the rim 14 shorten the distance that the center section 30 of support strap 24 hangs below rim 14. Thus, the end 20 of each channel strap 16 will be positioned into a more horizontal angle than that shown in FIG. 3.

If slit 23C is used for attaching onto rim 14, the end 20 of each channel strap 16 will hang in a more vertically aligned direction.

The net 12 is installed by first attaching the top ends 18 of the channel straps 16 to the rim 14 so that the channel straps 16 hang vertically downward. The opposite ends 26 and 28 of each support strap 24 are then attached to the rim on opposite lateral sides of the channel straps 16. Thus, the bottom ends of the channel straps 16 are raised upward shaping the channel straps 16 into the downwardly sloping convex arch shown in FIG. 3. The slope of the arch formed with the channel straps 16 dictate a given vertical return angle in which a basketball exits through basketball net 12. For example, when the ends 20 of channel straps 16 are raised into more of a horizontal alignment, the basketball will exist net 12 in a more horizontal angle. When the ends 20 of channel straps 16 are positioned in a more vertical direction, the ball will exit net 12 in a more vertically downward direction. The angle of the channel straps 16 control the speed that a basketball exits net 12. For example, when the bottom ends 20 of channel straps 16 are horizontal, the basketball will exit the net 12 at a slower speed than when the channel straps drape below rim 14 in a more vertical angle.

Figure 4:
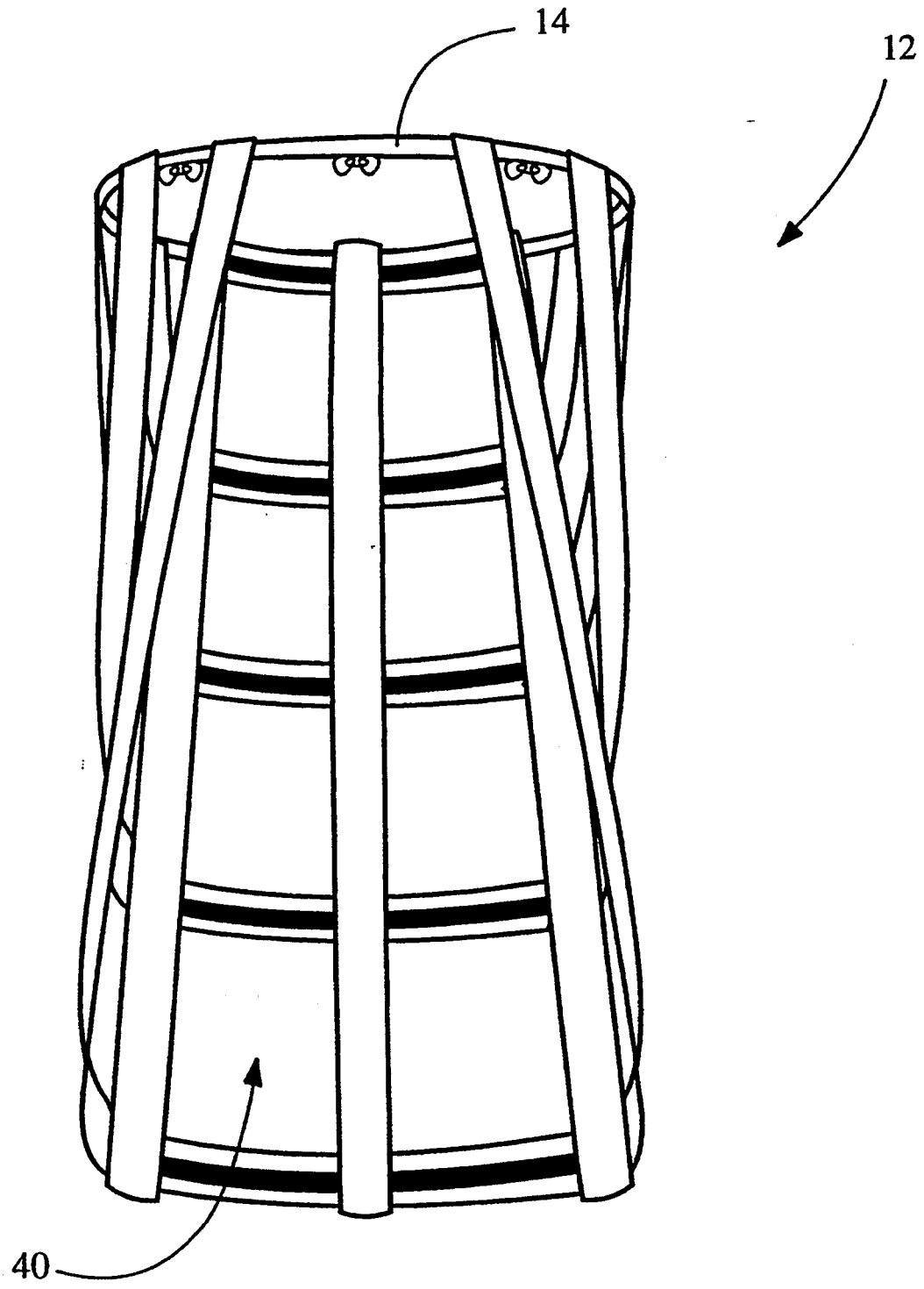
FIG. 4 is a front elevation view of the basketball net shown in FIG. 3.
Figure 5:
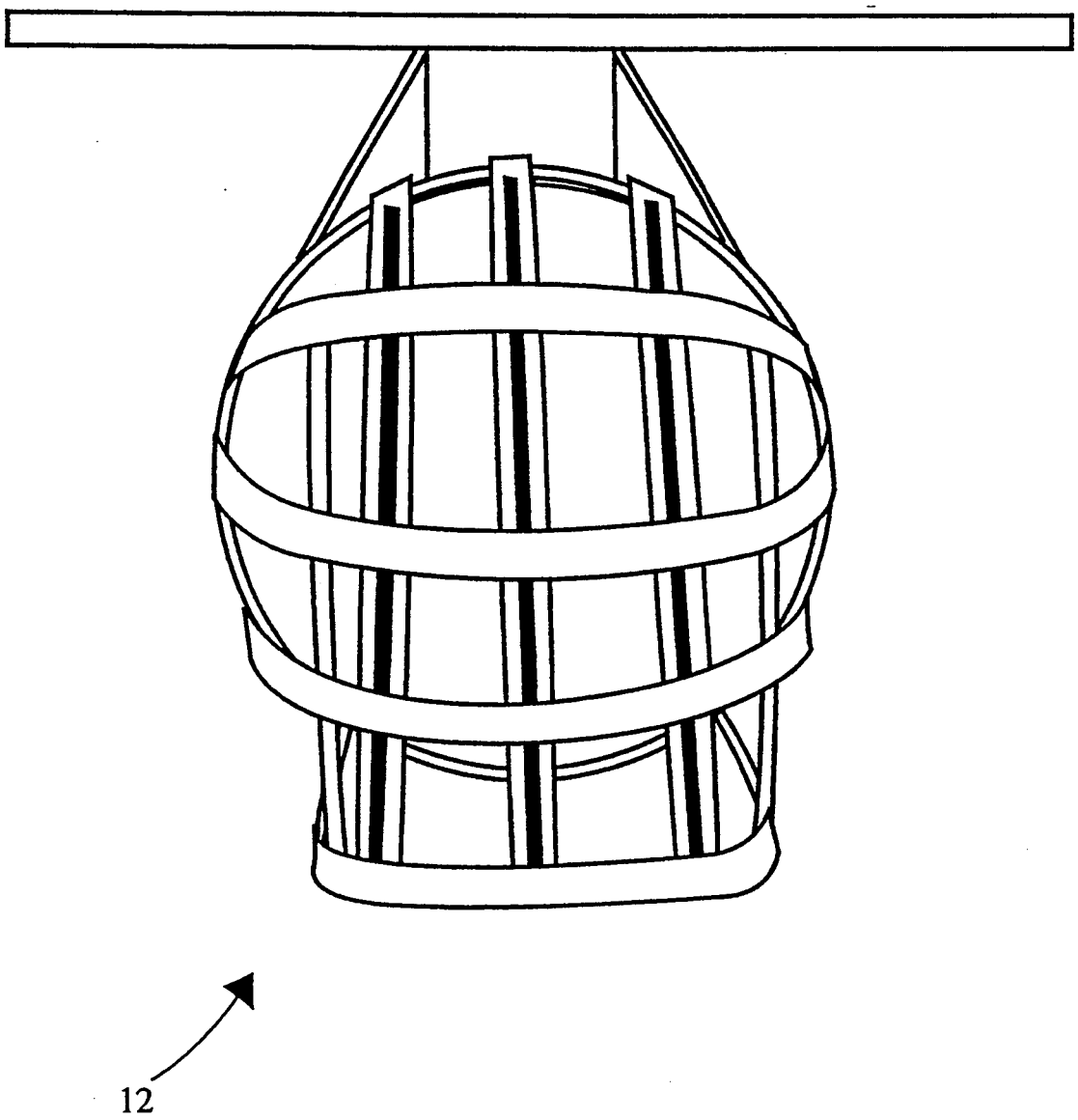
FIG. 5 is a bottom view of the basketball net shown in FIG. 3.

FIG. 4 is a front view of the basketball net 12 and FIG. 5 is a bottom view of the net 12. It can be seen that net 12 forms a chute 40 that controls the lateral direction that the basketball as it exists net 12. The net 12 can be attached at different radial angles about rim 14 thereby controlling the direction that the basketball exist from chute 40.

Figure 6:
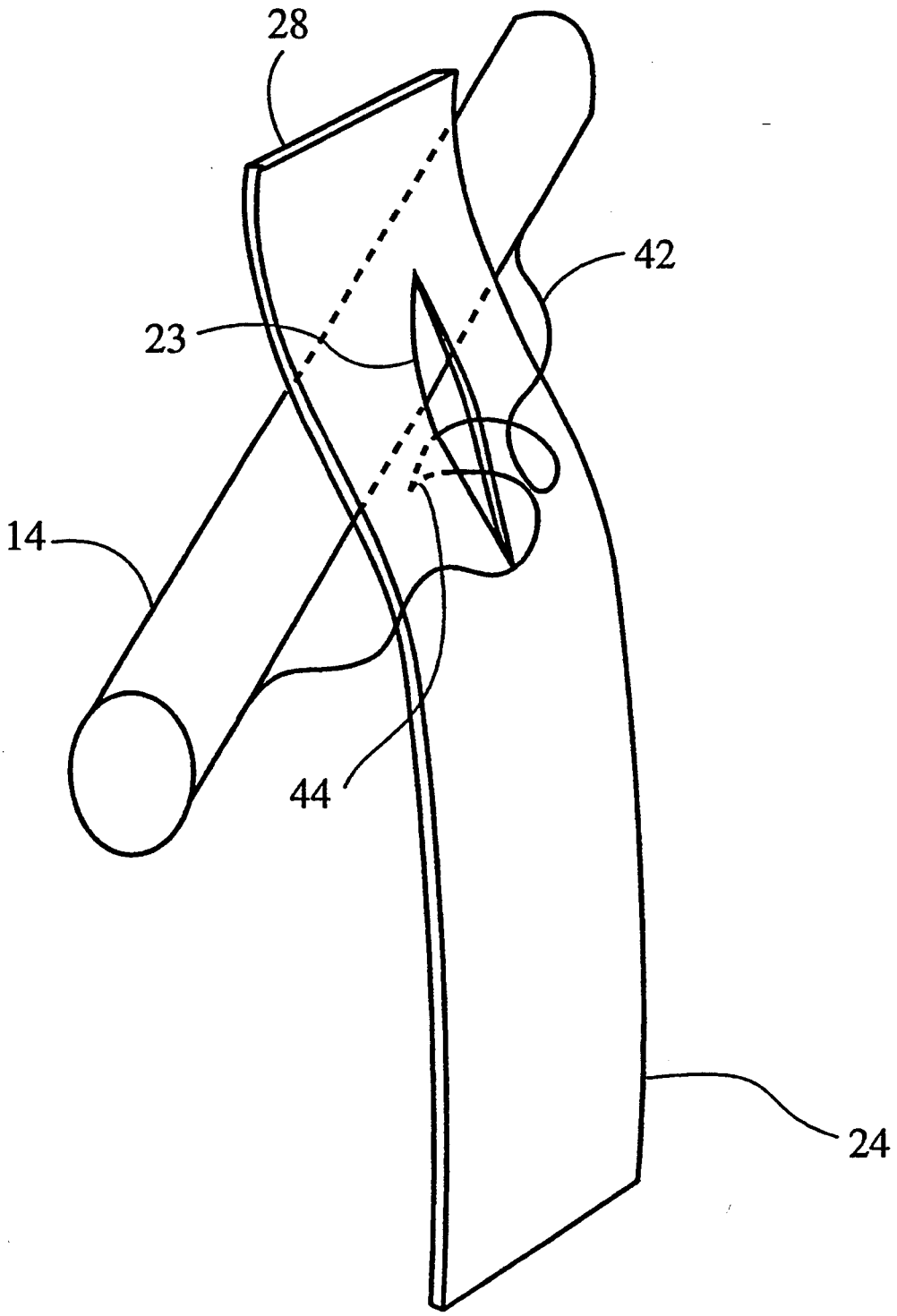
FIG. 6 is a detailed view of a strap end for the basketball net shown in FIG. 1.

FIG. 6 is a detailed view of the end of support strap 24. The slit 23 is inserted between a bracket 42 and rim 14. The slit 23 is then placed around the nose 44 of bracket 42 securing the end of support strap 24 to rim 14. The same installation process is performed for the slits 23 at the top end 18 of channel straps 16. Thus, the net 12 can be quickly attached and detached to standard basketball rims. The net 12 can also be attached while a conventional basketball net 36 is also attached to rim 14.

Having described and illustrated the principles of the invention in a preferred embodiment thereof, it should be apparent that the invention can be modified in arrangement and detail without departing from such principles. I claim all modifications and variation coming within the spirit and scope of the following claims.

What is claimed is:

1. A basketball net for directing the return path of a basketball after passing through a rim, comprising:

at least one elongated flexible channel strap having a top end and a bottom end, the top end of each channel strap having attachment means for coupling directly onto the basketball rim; and at least one flexible support strap having a first end, a second end and a center portion, the first and second end coupled to the rim and the center portion attached laterally across the bottom end of the channel strap forming said channel strap into a downwardly sloping concave arch shape; and adjustment means joined to the first and second ends of the support strap that vary how far the center section of the support strap hangs below the rim, thereby, varying the shape of the arch formed with the channel strap.

2. The basketball net according to claim 1 wherein the channel strap and support strap are made of a flexible fabric type material.

3. The basketball net according to claim 1 including detachable semi-rigid bands attached onto both the channel strap and support strap for increasing the rigidity of the straps while at the same time conforming to the shape of the attached strap.

4. The basketball net according to claim 3 wherein the bands comprise elongated rectangular pieces of plastic.

5. The basketball net according to claim 3 wherein the intersection of the channel strap and the support strap form a center slot for receiving and holding the band.

6. The basketball net according to claim 5 wherein the attachment means comprises snaps having a male and female section attached to each end of each support strap and the top end of the channel strap.

7. The basketball net according to claim 1 wherein the attachment means for each strap comprises individual hook and eye sections each having an elongated rectangular shape, each hook section attached to an end location of an associated strap that wraps around the rim and mates with a corresponding eye section attached below the hook section.

8. The basketball net according to claim 6 wherein the band has substantially the same profile as the channel strap.

9. The basketball net according to claim 1 including multiple elongated side straps attached laterally across the support strap and positioned in parallel alignment with the channel strap.

10. A basketball net for attaching onto a basketball rim, comprising:

multiple elongated flexible channel straps each aligned in a parallel fashion and having a first and second end, the first end of each channel strap attached to the rim; and multiple elongated flexible support straps each having a first and second end attached to opposite sides of the rim, respectively, and a center section attached transversely across each channel strap thereby forming a flexible bottom section having a downwardly arching slope.

11. A basketball net according to claim 10 including separate quick release attachment means joined to the ends of each channel and support strap, the end of each strap wrapped through a bracket welded to the bottom of the rim.

12. The basketball net according to claim 11 wherein each attachment means comprises multiple slits extending through the ends of each support strap and through the top end of the channel strap, the slits separately varying the distance that the associated support strap hangs below the rim.

13. The basketball net according to claim 10 including semi-rigid bands attached across the center section of each support strap and across the channel straps for increasing rigidity of only the bottom section of the net.

14. A method for controlling the direction that a basketball travels through a basketball net, comprising:

providing an adjustable basketball net having a set of parallel channel straps each having a top and bottom end and a set of side straps each having opposite ends and a center section joined transversely across the channel straps;

attaching the top ends of the channel straps to the rim so that the channel straps hang vertically downward; and attaching the ends of each support strap to the rim on opposite lateral sides of the channel straps thereby raising the bottom ends of the channel straps upward shaping the channel straps into a downwardly sloping convex arch, the slope of the arch formed with the channel straps defining a given basketball return angle in which a basketball exits through said basketball net.

15. A method according to claim 14 including changing the return angle of the basket ball by varying the shape of the arch formed with the channel straps.

16. A method according to claim 15 wherein the shape of the channel straps is changed by varying how far the center sections of each side strap hang below the rim.

17. A method according to claim 14 wherein a variable location at the opposite ends of the side straps can be attached to the rim for adjusting the shape of the net as it hangs below the rim.

18. A method according to claim 14 including the following steps:

providing a conventional basketball net having an inverted conical shape and loops at a top end that attach to the rim; and wrapping the ends of the adjustable basketball net to the rim between the loops of the conventional basketball net so that the adjustable basketball net drapes around the outside of the convention basketball net.

19. A method according to claim 14 including rotating the net around the rim for controlling which direction a basketball will exist from said net.

20. A method according to claim 14 wherein a basketball passing through the net exists at a given speed and including the step of controlling the speed that a basketball exists said net by varying the shape of the arch formed by the channel straps.

* * * * *